United States Patent [19]

Boje et al.

[11] 4,143,929

[45] Mar. 13, 1979

[54] CURRENT COLLECTOR

[75] Inventors: Jürgen Boje, Frankfurt am Main; Horst Bratengeier, Neu-Isenburg; Karel Zaveta, Münster; Günter Schumann, Ober Roden, all of Fed. Rep. of Germany

[73] Assignee: Messer Griesheim GmbH, Frankfurt am Main, Fed. Rep. of Germany

[21] Appl. No.: 789,402

[22] Filed: Apr. 21, 1977

[30] Foreign Application Priority Data

Apr. 29, 1976 [DE] Fed. Rep. of Germany ..... 2618782

[51] Int. Cl.[2] ..... H01R 39/00

[52] U.S. Cl. ..... 339/5 M; 339/6 R

[58] Field of Search ..... 339/5 M, 5 RL, 5 R, 339/5 P, 6 RL, 6 R, 8 P, 8 RL

[56] References Cited

U.S. PATENT DOCUMENTS

| | | | |
|---|---|---|---|
| 2,924,800 | 2/1960 | Scarborough | 339/5 M |
| 3,614,726 | 10/1971 | Richter, Jr. et al. | 339/5 M X |

*Primary Examiner*—Roy Lake
*Assistant Examiner*—DeWalden W. Jones
*Attorney, Agent, or Firm*—Connolly and Hutz

[57] ABSTRACT

A current collector for a photoscope of a photoelectric control installation of a flame cutting machine has an insulating plate having plug mounting means on one side and electrically connected contact wires on the other side with the contact wires arranged in a single row with their free spring ends taken up by a comb.

7 Claims, 5 Drawing Figures

CURRENT COLLECTOR

BACKGROUND OF THE INVENTION

The invention is concerned with a current collector for the photoscope of a photoelectric control arrangement intended for use in a flame cutting machine and consisting of an insulating plate, which has a mounting for electrical plugs on one side and on the other side has contact wires electrically connected with the plugs.

The control of the well known flame cutting machine results photoelectrically via a so-called photoscope, the detector head of which scans the form of the workpiece to be flame cut on a drawing by travelling along the drawing's lines. The movement of the detector head effected by the lines is transmitted via the control element of the photoscope to the proper control installation of the flame cutting machine, by which the movement of the torches is controlled.

The detector hand of the photoscope is in itself of known construction and has aside from its optical arrangement, a number of photocells by means of which the drawing lines are scanned. Each photocell is electrically connected to a contact ring, or the like, which is mounted onto the housing interior side of a roller which carries the detector head.

To these contact rings (on the outer side of the roller), a current collector is attached which is electrically connected with the control arrangement of the photoscope. According to the incidence of light into the photocells, these produce weak controlling currents which are lead via the current collector into the collection apparatus by means of which the drives of the detector head as well as the control apparatus for the movement of the cutting torches are actuated.

A known current collector (later described) is built into the photoscope and has an insulating plate with the plugs mounted on one side thereof and their electrically connected contact wires disposed on the other side thereof. These wires are arranged in two rows facing each other with the wires facing each other being electrically connected. A roller carrying rings is disposed between both rows of wires whereby a pair of such wires touches each contact ring.

A disadvantage with these known current collectors is that the contact wires are relatively rigid and unmovable and as a result, the danger is often encountered, that after long usage, due to wear, a connection between the wires and the contact rings is no longer guaranteed.

Furthermore, the rigid contact wires have no side play so that it can happen as a result, for example, that a wire comes in contact with a contact ring on the roller of the detector head other than the contact ring corresponding to it.

SUMMARY OF THE INVENTION

Proceeding from these disadvantages, it is an object of the invention to provide a current collector for the photoscope of a flame cutting machine which continuously touches the current contact ring with its individual wires and which in spite of simple construction, remains functional over a long use period.

This object is accomplished by arranging the contact wires in a single row and taking them up by a comb at their springy ends.

According to the preferred practice of the invention, it is provided that the contact wires are bent in the shape of a hairpin and that the at times longer portions of these wires is essentially parallel to the insulating plate.

It is further of advantage if, according to the invention, the comb consists of several pins grouped at equal distance from one another, the free ends of the contact wires being guided between them.

Due to structure of the current collector, according to the invention, it is assured that its springy contact wires continuously touch the contact rings of the roller. It is furthermore advantageously assured that, because of the comb which guides the free ends of the contract wires, a sideway shift is avoided, so that a connection of a contact wire with another adjacent contact ring is not possible.

THE DRAWINGS

DETAILED DESCRIPTION

Figure 1:
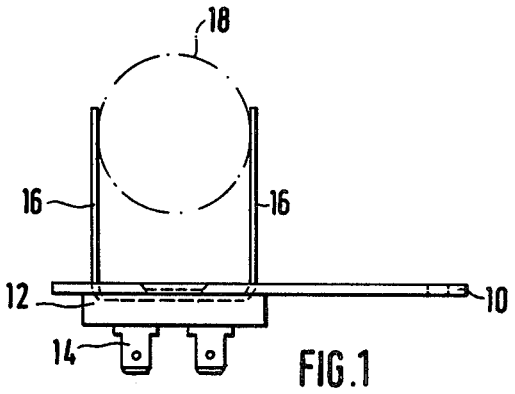
FIG. 1 is a side view of a known current collector.
Figure 2:
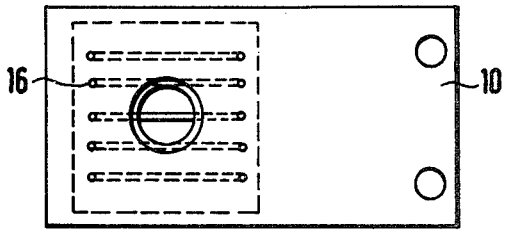
FIG. 2 is a top view of the current collector of FIG. 1.

A known current collector, as it is built into a photoscope, consists — as shown in FIGS. 1 and 2 of the drawing — of an insulating plate 10, on one side of which a mounting 12 for plugs 14 is provided, and on the other side are contact wires 16 which are electrically connected with the plugs 14. As especially shown in FIG. 2, the contact wires 16 are arranged in two rows facing each other whereby the wires directly facing each other are electrically connected.

Between both rows of wires is the roller 18 carrying the detector head with the contact rings (not shown) attached, whereby a pair of wires (facing each other) touches each contact ring.

Figure 4:
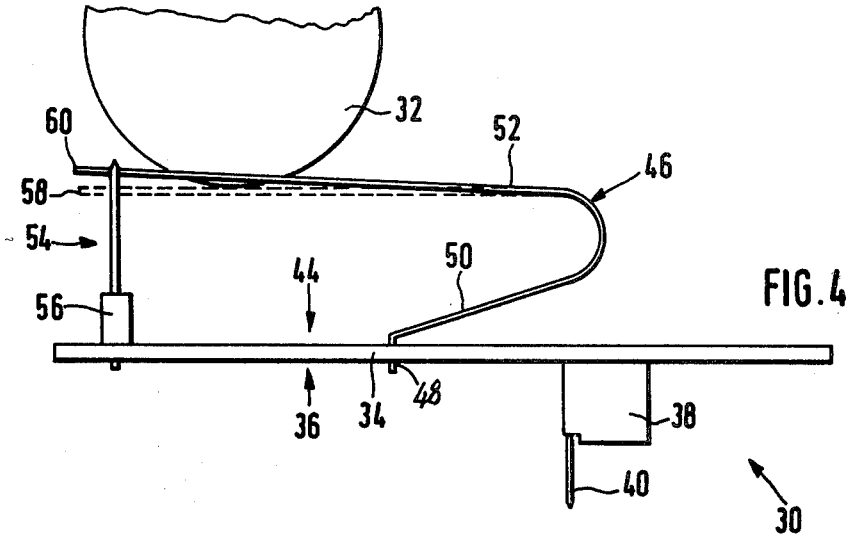
FIG. 4 is a side view of the current collector of FIG. 3.
Figure 3:
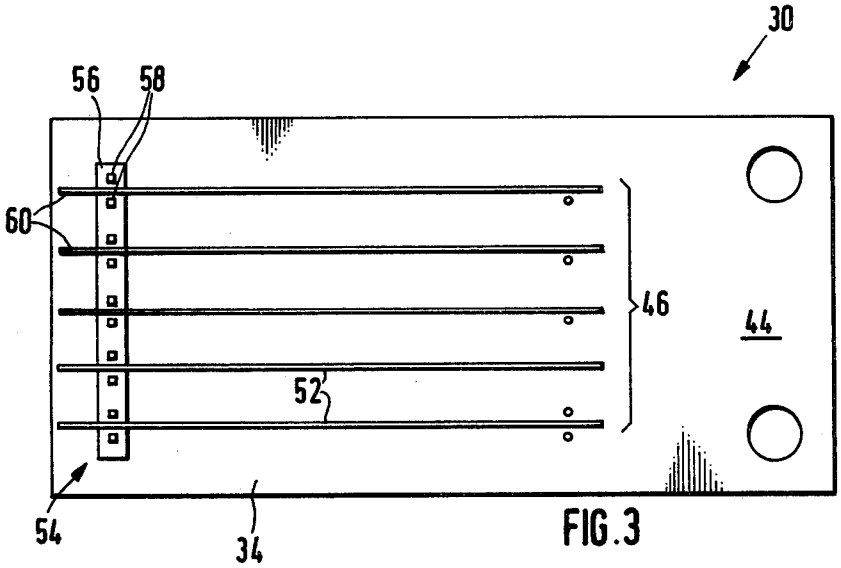
FIG. 3 is a top view of the current collector according to the invention.
Figure 5:
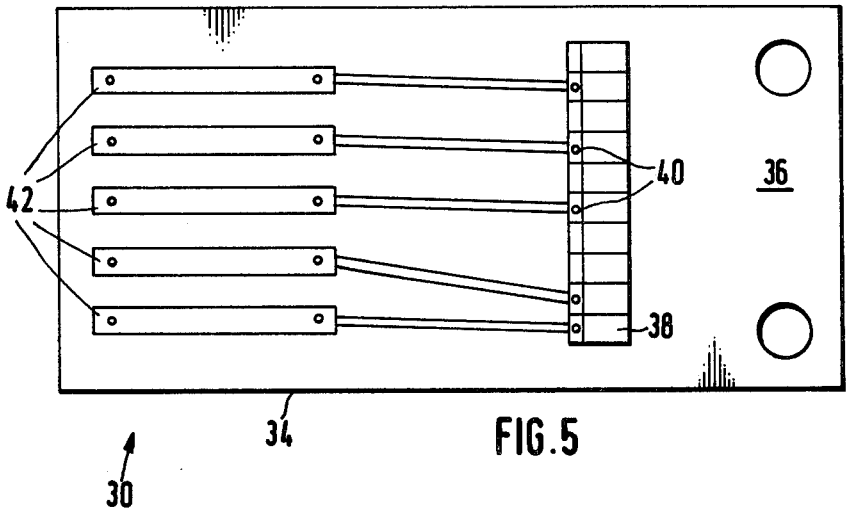
FIG. 5 is a bottom view of the current collector from FIG. 3.

In FIGS. 3 to 5, a current collector 30 according to the invention is illustrated, which is coupled with a roller 32 belonging to the turnable detector head (not illustrated) of a photoscope for a flame cutting machine. The current collector 30 has an insulating plate 34, on the bottom 36 (FIG. 5) of which a strip 38 with several — five in the illustrative example — plugs are set having prongs 40.

A separate conductor 42 is allotted to each of these plugs — as further shown in FIG. 5.

As FIGS. 3 and 4 indicate, a single row of five contact wires 46 is provided on the upper side 44 of the insulating plate. Each of these contact wires is electrically connected with one of the conductors 42, provided on the bottom side 36, by a solder spot 48. The shape of the contact wires 46, according to the invention is illustrated in FIG. 4. As can be seen, the contact wire is hairpin shaped, its shorter lower part 50 being connected to the conductor 42 and after a bend, changes into the longer part 52 which runs essentially parallel to the insulating plate 34.

According to FIGS. 3 and 4, at the left side of the insulating plate 34, a comb is provided, which consists of a strip 56 which serves to hold several pins 58. As FIG. 3 shows, the comb 54 has ten pins 58 of which two are associated with the free springy end 60 of a contact wire 46 at any given time. Such a pair of pins serves — as shown in FIG. 3 — to guide the springy end 60 of the hairpin shaped contact wire 46. Each of the five pairs of pins is electrically connected to the same conductor 42 as is the contact wire taken up by this pair of pins.

As a result of these pins, a side shift of the contact wires is prevented. When installing the current collector 30 in the photoscope, it is so adjusted that the contact wires are pressed in toward the insulating plate 34 and thereby the free springy ends 60 are completely taken by the pins 58 for guiding purposes; see the phantom line illustration of a contact wire in FIG. 4. According to the invention, it is no longer necessary to adjust the contact pressure, in other words, the force with which a contact wire touches the roller, since the spring contact wires 46 adjust "automatically" whereby an optimal life span of the current collector is assured. It is furthermore assured that because of the comb 54, a sideway shift of one of the contact wires, whereby the danger of control failure exists, is effectively prevented.

What is claimed is:

1. In a current collector for the photoscope of a photoelectric control installation which is provided in a flame cutting machine, consisting of an insulating plate which is provided on one side with a mounting for electric plugs and on the other side with contact wires which are electrically connected with the plugs, characterized by the fact that said contact wires are arranged in a single row, said contact wires having free springy ends taken up by a comb, said comb being formed by a plurality of pins, and each of said contact wires being disposed between a respective pair of said pins.

2. In a current collector according to claim 1, characterized by the fact that said contact wires are curved in the shape of a hairpin with the longer part of said wires being positioned essentially parallel to said insulating plate.

3. In a current collector according to claim 2, characterized by the fact that each of said contact wires is attached by its shorter part to a conductor provided at the bottom of said insulating plate, and each of said conductors being connected with one of said plugs.

4. In a current collector according to claim 3, characterized by the fact that said comb consists of several pins arranged at equal distance from one another between which said free ends of said contact wires are guided.

5. In a current collector according to claim 4, characterized by the fact that each of said contact wires and said pins of said comb are connected with the same conductor.

6. In a current collector according to claim 1, characterized by the fact that said comb consists of several pins arranged at equal distance from one another between which said free ends of said contact wires are guided.

7. In a current collector according to claim 6, characterized by the fact that each of said contact wires and said pins of said comb are connected with the same conductor.

* * * * *